US007640857B2

(12) United States Patent
Kneisl

(10) Patent No.: US 7,640,857 B2
(45) Date of Patent: Jan. 5, 2010

(54) PROTECTIVE ELECTRICALLY CONDUCTIVE LAYER COVERING A REACTIVE LAYER TO PROTECT THE REACTIVE LAYER FROM ELECTRICAL DISCHARGE

(75) Inventor: Philip Kneisl, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 462 days.

(21) Appl. No.: 11/425,950

(22) Filed: Jun. 22, 2006

(65) Prior Publication Data

US 2007/0169657 A1 Jul. 26, 2007

Related U.S. Application Data

(60) Provisional application No. 60/766,493, filed on Jan. 23, 2006.

(51) Int. Cl.
*F42B 3/18* (2006.01)

(52) U.S. Cl. ..... 102/322; 102/332; 102/202.1; 102/304

(58) Field of Classification Search ..... 102/304, 102/322, 332, 202.1, 202.2; 89/1.15
See application file for complete search history.

(56) References Cited

U.S. PATENT DOCUMENTS 4,380,958 A * 4/1983 Betts ..... 102/202.2
4,422,381 A * 12/1983 Barrett ..... 102/202.2
5,027,707 A * 7/1991 Mei ..... 102/202.8
5,043,226 A * 8/1991 Wiedeman et al. ..... 428/461
5,773,748 A * 6/1998 Makowiecki et al. ..... 102/205
6,099,757 A * 8/2000 Kulkarni ..... 252/500
6,131,515 A * 10/2000 Cook et al. ..... 102/202.8
6,487,972 B1 12/2002 Cook et al.
6,648,097 B2 11/2003 Tite et al.
6,881,284 B2 * 4/2005 Makowiecki et al. .... 149/109.6
6,982,013 B1 * 1/2006 Fallis et al. ..... 149/19.1
7,278,354 B1 * 10/2007 Langan et al. ..... 102/306
2004/0060625 A1 * 4/2004 Barbee et al. ..... 149/15
2005/0178282 A1 8/2005 Brooks et al.

FOREIGN PATENT DOCUMENTS

GB 2269380 A 2/1994

OTHER PUBLICATIONS

Reactive Nanotechnologies, Inc., Making More out of Energy., RNT Technology Overview, 2005, 2 pages.

* cited by examiner

*Primary Examiner*—James S Bergin
(74) *Attorney, Agent, or Firm*—Kevin Brayton McGoff; James L. Kurka

(57) ABSTRACT

A tool for use in a wellbore has an activation assembly, which has a support structure and a reactive layer on the support structure. The reactive layer is formed of a pyrotechnic material. The activation assembly also includes an electrically conductive protective layer covering the reactive layer to protect the reactive layer from electrical discharge. The tool further includes a component to be activated by the activation assembly.

16 Claims, 3 Drawing Sheets

PROTECTIVE ELECTRICALLY CONDUCTIVE LAYER COVERING A REACTIVE LAYER TO PROTECT THE REACTIVE LAYER FROM ELECTRICAL DISCHARGE

CROSS-REFERENCE TO RELATED APPLICATION

This claims the benefit under 35 U.S.C. §119(e) of U.S. Provisional Application Ser. No. 60/766,493, entitled "Electro-Static Discharge Desensitized Pyrotecnic," filed Jan. 23, 2006.

TECHNICAL FIELD

The invention relates generally to providing a protective electrically conductive layer that covers a reactive layer (such as a reactive nanofoil) to protect the reactive layer from electrical discharge.

BACKGROUND

Various operations are performed in a wellbore to enable the production of fluids from, or injection of fluids into, a reservoir in a formation surrounding a section of the wellbore. Examples of operations performed in a wellbore include perforating operations (to extend perforations through any surrounding casing or liner and into a formation), fracturing operations (to create fractures in a formation), and other operations.

Certain operations involve the use of explosives. For example, perforating guns include shaped charges and detonating cords, and firing heads for perforating guns include primary and/or secondary explosives. Explosives can also be used in other types of downhole tools, such as propellants (which are considered low explosives) used in fracturing tools for performing fracturing jobs.

When components containing explosives are being handled by humans, they present a safety hazard if adequate precautions are not taken. Typically, for well applications, components containing explosives are transported from a storage facility or manufacturing facility (or other type of facility) to the well site. At the well site, the components are assembled by well operators into a tool for deployment into a wellbore. During handling by humans, electrostatic discharge (ESD) may occur, which can cause inadvertent initiation of the explosive being handled. Such inadvertent initiation of explosives can cause serious injury or even death. Typically, components such as detonators that contain explosives include circuitry for ESD protection. However, conventional ESD protection, such as those implemented with spark gaps, are not always effective due to the possibility of manufacturing defect.

SUMMARY

In general, an apparatus comprises an activation assembly for explosives, where such activation assembly includes elements that are desensitized so as to be resistant to electrostatic discharge.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
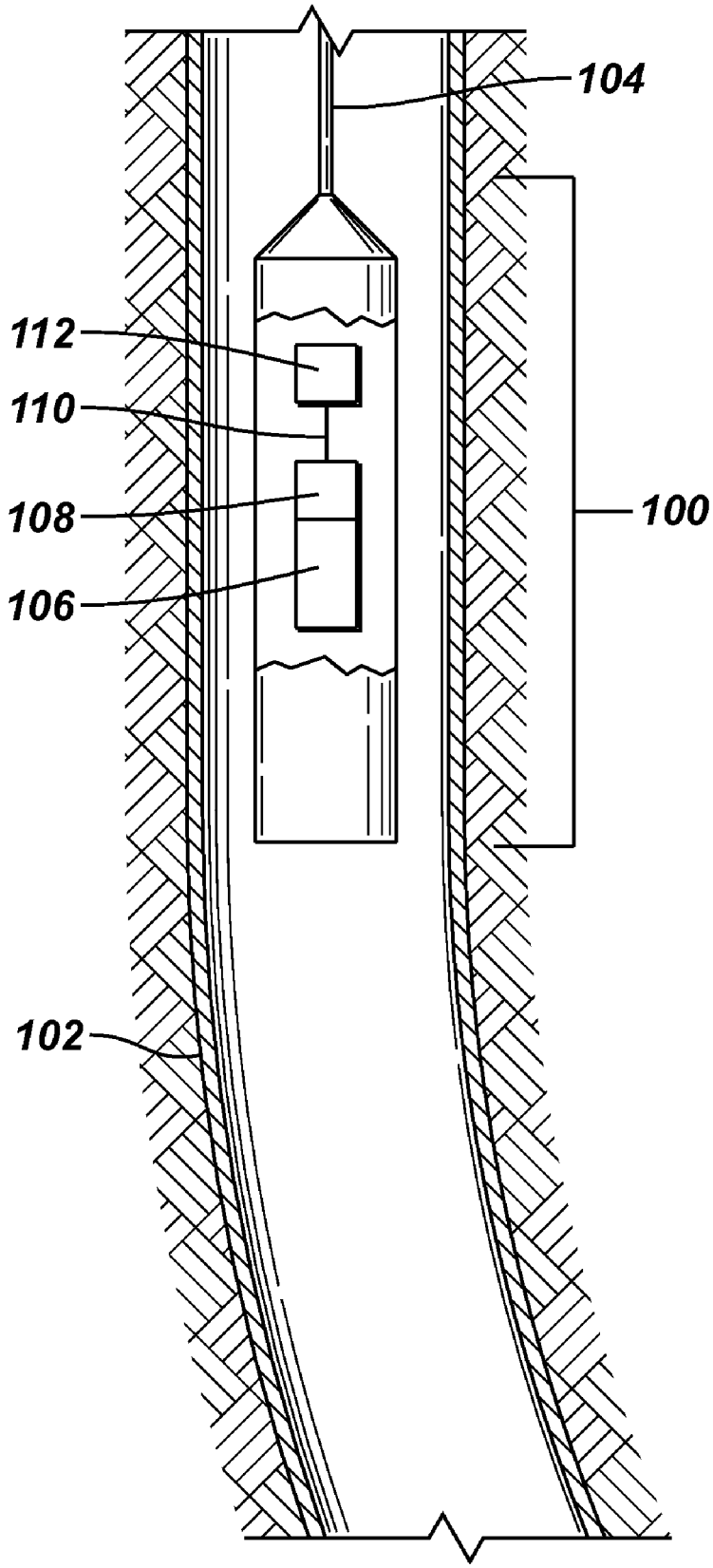
FIG. 1 illustrates a tool deployed in a wellbore, where the tool incorporates an embodiment of the invention.

FIG. 1 illustrates a tool 100 that is deployed in a wellbore 102, such as a wellbore for producing hydrocarbons from a reservoir surrounding the wellbore 102. In an alternative implementation, the wellbore 102 can be used for injecting fluids into a reservoir. In other implementations, the wellbore 102 can be used for other purposes, such as to produce other types of fluids (e.g., water). Additionally, although described in the context of a wellbore environment, it is noted that some embodiments can be used in other applications, such as mining applications, geological survey applications, and so forth.

The tool 100, which includes an explosive 106, is deployed on a carrier line 104, such as a wireline, tubing, slickline, and so forth. Examples of the tool include perforating tools, detonators, pipe cutters, valve actuators, packer actuators, fracturing tools, and so forth. The explosive 106 is coupled to an activation assembly 108 according to some embodiments, which is used to activate the explosive 106. The activation assembly 108 is connected over a link 110 to a control unit 112, which control unit can be an electrical control unit for supplying an electrical activation signal over the link 110 to the activation assembly 108. For example, the control unit 112 can supply a pulse of electrical energy to the activation assembly 108 for activating the activation assembly 108. In other embodiments, the control unit 112 and activation assembly 108 can be integrated together rather than provided as separate units.

In some implementations, the explosive 106 can be a low explosive, such as propellant, that has a relative low reaction rate. Propellants can be used in tools for performing fracturing operations. Initiation of a propellant causes generation of high-pressure gas in the wellbore, which high-pressure gas can be used to create fractures in the surrounding formation during a fracturing operation. In other implementations, the explosive 106 can be a high explosive, such as a primary explosive or secondary explosive, which has a relatively high reaction rate. Primary and secondary explosives are generally used in detonators for detonating other explosives, such as a detonating cord or shaped charges of a perforating gun. In other example implementations, explosives can have other applications.

One safety concern associated with handling of components containing explosives is inadvertent activation due to electrostatic discharge (ESD) from a person's hand or from a tool held by the person. If the component is not properly protected against ESD, then the ESD can cause inadvertent activation of the activation assembly to cause initiation of the explosive, which can result in serious injury, death, and/or damage to property.

In accordance with some embodiments the activation assembly 108 includes a protection mechanism to prevent or reduce the likelihood that ESD (or other forms of electrical discharge) will cause inadvertent activation of the activation assembly 108. The activation assembly 108 according to an example embodiment includes a reactive nanofoil, which contains a pyrotechnic mixture that exhibits redox reaction in response to an input to energy (such as an electrical signal pulse supplied by the control unit 112). The reactive nanofoil includes a reactive intermetallic material, which contains a fuel that reacts with an oxidizer to release energy.

Figure 2:
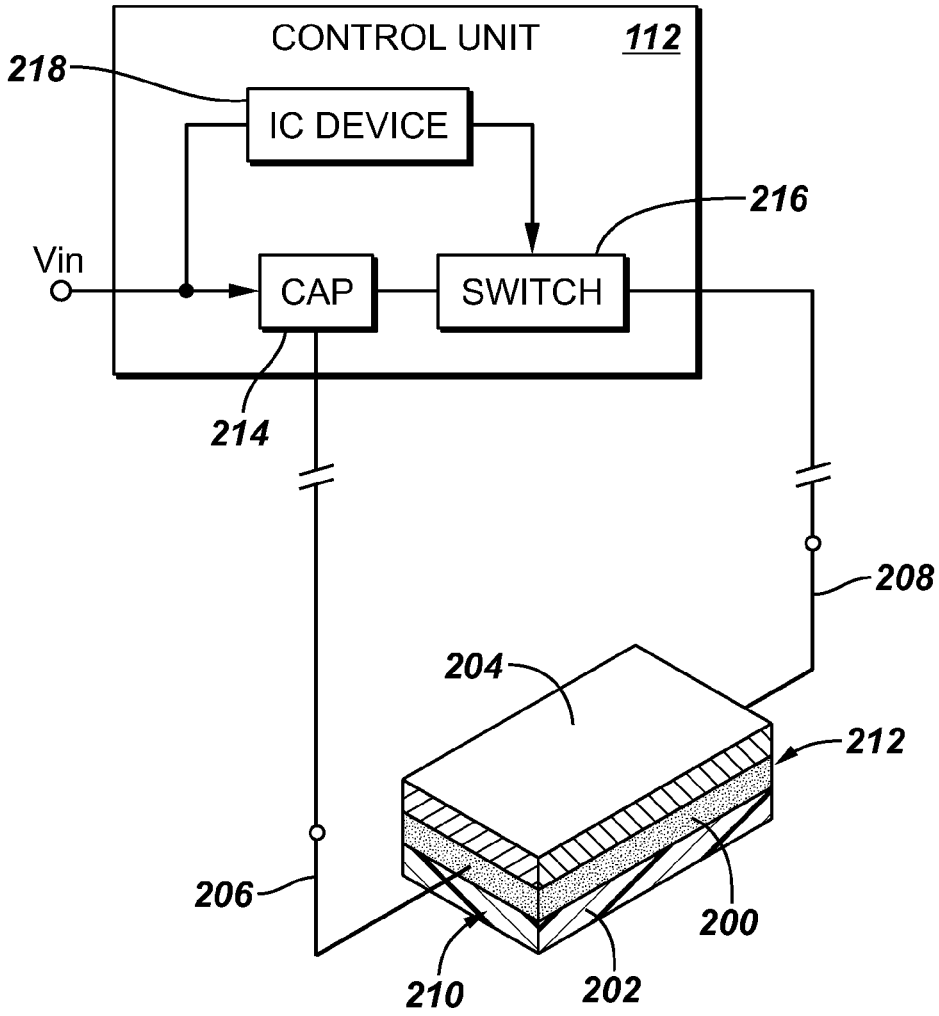
FIG. 2 illustrates an activation assembly that has a protection mechanism that provides electrostatic discharge (ESD) protection, in accordance with some embodiments.

As depicted in FIG. 2, the reactive nanofoil is shown as a layer 200 formed on a support structure 202. In one embodiment, the nanofoil layer 200 is produced by sputtering aluminum and nickel onto the support structure 202, which can be a plastic sheet (e.g., polyethyleneterphalate or PET). The composition containing the aluminum and nickel is one example of an intermetallic compound. In other embodiments, the nanofoil layer 200 can be formed using other intermetallic compounds, such as compositions made of aluminum and palladium, titanium and boron, or other compositions. More generally, the layer 200 is referred to as a reactive layer, which can be formed of a pyrotechnic material. An intermetallic material is a type of pyrotechnic material. Other examples of pyrotechnic materials include the following elements or combination of elements: (1) titanium; (2) potassium-perchlorate; (3) zirconium, and so forth.

Also, instead of using plastic, the support structure 202 can also be formed using other insulating materials. Alternatively, the support structure 202 can also be formed of a metal.

To provide ESD protection, an electrically conductive protective layer 204 covers the reactive layer 200. The protective layer 204 is considered to "cover" the reactive layer 200 if the protective layer 204 covers enough of the reactive layer 200 to provide electrical discharge protection for the reactive layer 200. The protective layer 204 can be formed of an electrically conductive metal such as aluminum, silver, gold, and so forth. Electrically conductive non-metallic materials can also be used in other implementations. In one example implementation, an aluminum foil can be laminated as a layer onto a surface of the reactive foil layer 200. In another implementation, a paint containing an electrically conductive material (such as silver) can be coated onto the surface of the reactive foil layer 200. Alternatively, a gold conductive layer can be sputter coated onto the surface of the reactive layer 200. Thus, generally, the protective layer may be formed by laminating a conductive foil to the surface of the reactive layer 200, by painting the surface of the reactive layer 200 with a conductive substance, or by sputtering a non-reactive, conductive material onto the reactive surface. Other techniques of forming an electrically conductive layer on a surface of the reactive layer 200 can be used in other embodiments.

Generally, the protective layer 204 is substantially more electrically conductive (in other words, possesses substantially less resistance) than the reactive layer 200. In this manner, the protective conductive layer 204 serves as an electrical path to conduct induced ESD currents to ground. Since the electrical current passes through the conductive layer 204 and not the reactive layer 200, the reactive material of the reactive layer 200 is not heated and no reaction takes place (so that activation of the activation assembly is avoided).

As furthered depicted in FIG. 2, electrically conductive leads or wires 206 and 208 are connected to points on the reactive layer 200. In the implementation depicted in FIG. 2, the electrically conductive lead 206 is connected to a first side 210 of the reactive layer 200, whereas the electrically conductive lead 208 is corrected to a second side 212 of the reactive layer 200. In the example implementation depicted in FIG. 2, the sides 210 and 212 are on opposite ends of the reactive layer 200. In alternative implementations, the leads 206 and 208 can be connected to other sides of the reactive layer 200.

As further shown in FIG. 2, the electrically conductive leads 206, 208 are driven by the control unit 112. The control unit 112 includes an energy storage device, such as a capacitor 214 or battery. In other implementations, other types of storage devices, such as batteries, can be employed in the control unit 112. A switch 216 is connected between the capacitor 214 and the electrically conductive lead 208. The switch 216 when in the open position isolates the energy stored in the capacitor 214 from the reactive layer 200. However, in the closed position, the switch 216 electrically connects the energy in the capacitor 214 onto the electrically conductive lead 208.

The switch 216 is controlled by an integrated circuit (IC) device 218. Alternatively, other types of controller devices can be used. The capacitor 214 is further coupled to an input voltage Vin, which is used to charge the capacitor 214 to a predetermined voltage. In a downhole environment, Vin can be coupled to an electrical conductor in the carrier line 104 (FIG. 1) that is run from the earth surface of the wellbore 102. In an alternative implementation, the control unit 112 can be configured to receive optical signals that are transmitted over a fiber optic line (provided in the carrier line 104), with the control unit 112 including a converter to convert the optical signals into electrical energy to charge the capacitor 114 (or other type of energy storage device).

In operation, the tool 100 is run into the wellbore 102 to a target depth. At that point, electrical energy can be provided down the carrier line 104 to charge up the capacitor 214. Next, an activate command can be sent down the carrier line 104, which activate command is received by the IC device 218. In response to the activate command, the IC device 218 closes the switch 216 to couple the electrical energy of the capacitor 214 onto the electrically conductive lead 208. As a result, a voltage pulse is provided onto the electrically conductive leads 206, 208, which causes an electrical current to pass through the reactive layer 200 to heat the reactive layer such that a reaction results. In some embodiments, the voltage pulse provided by the control unit 112 can be a relative low-voltage pulse. The reaction provided in the reactive layer 200 causes ignition of any explosive that is contacted to (or otherwise in sufficient close proximity to) the activation assembly 108 shown in FIG. 2.

Figure 3:
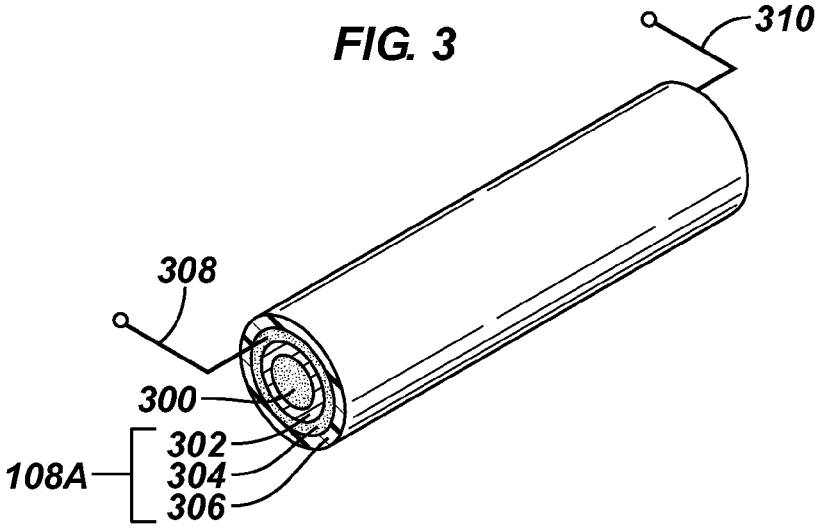
FIG. 3 illustrates a propellant that is attached to an activation assembly in accordance with an embodiment.

For example, as depicted in FIG. 3, the explosive can be a propellant stick 300. In the example depicted in FIG. 3, the propellant stick 300 has generally a cylindrical shape. Note, however, that the propellant 300 can have other shapes in other implementations. An activation assembly 108A is wrapped around the propellant stick 300, with the activation assembly 108A having multiple layers 302, 304, 306 each generally being cylindrically shaped. The activation assembly 108A includes an electrically conductive protective layer 302, a reactive layer 304, and a support structure 306. The protective layer 302 provides ESD protection for the reactive layer 304.

The propellant stick 300 has a curved surface that extends along a direction that is generally parallel to the longitudinal axis of the propellant stick 300. The activation assembly 108A is wrapped around this curved surface of the propellant stick 300.

Electrically conductive leads 308, 310 are connected to two opposite ends of the reactive layer 304. When a voltage pulse is applied onto the electrically conductive leads 308, 310, the reactive layer 304 is initiated. The initiated reactive layer 304 burns through the conductive layer 302 to cause initiation of the propellant stick 300. The benefit offered by wrapping the activation assembly 108A around the propellant stick 300 is that the entire outer surface of the propellant stick 300 (that is contacted to the activation assembly 108A) can be ignited substantially simultaneously. In a fracturing operation, the simultaneous ignition of the entire surface of the propellant stick 300 allows more rapid pressurization without risk of fragmenting the propellant stick 300.

Figure 4A:
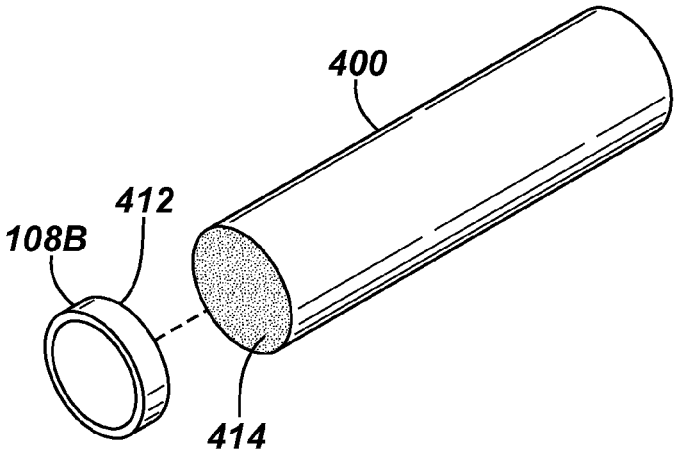
FIGS. 4A-4C illustrate an explosive attached to an activation assembly according to another embodiment.
Figure 4B:
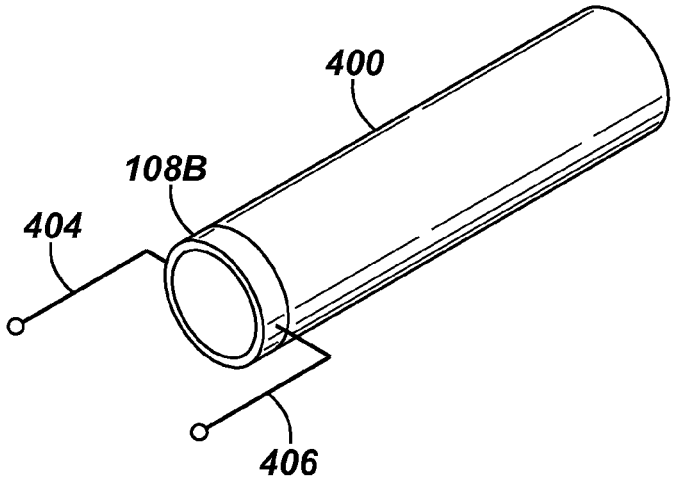
Figure 4C:
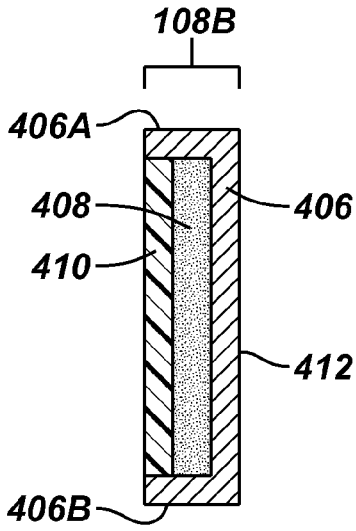

FIGS. 4A-4C illustrate another example embodiment, in which an explosive 400 (which can be a high explosive such as a primary explosive or secondary explosive) is activated by an activation assembly 108B. The explosive 400 is also generally cylindrical in shape. Note, however, that the explosive 400 can have other shapes in other implementations. In the implementation of FIGS. 4A-4C, the activation assembly 108B is generally shaped as a disk (although other shapes can be used in other embodiments). One surface 412 of the disk 108B is contacted to an end surface 414 of the explosive 400, as depicted in FIG. 4B.

Electrically conductive leads 404, 406 are connected to the activation assembly 108B. More specifically, the electrically conductive leads 404, 406 are connected to the reactive layer 408 of the activation assembly 108B (the reactive layer 408 is shown in FIG. 4C). The reactive layer 408 is provided between a support structure 410 and an electrically conductive protective layer 406 that provides the contact surface 412 of the activation assembly 108B. As with the embodiment of FIG. 3, the electrically conductive layer 406 provides ESD protection against inadvertent initiation of the reactive layer 408. Note that in the embodiment depicted in FIG. 4C, the protective layer 406 has two side portions 406A, 406B (bent at about right angles from the main part of the protective layer 406) that are contacted to the sides of layers 408 and 410. These side portions 406A, 406B provide further ESD protection. The arrangement of FIG. 4C depicts an arrangement in which the reactive layer 408 is completely enclosed by the combination of the support structure 410 and protective layer 406.

By using electrically conductive protective layers according to some embodiments, activation assemblies that include relatively sensitive pyrotechnic materials can be safely handled. In one example, the activation assembly that includes a pyrotechnic material can be desensitized so as to be resistant to an ESD stimulus up to about 20 mJ (milli-Joules). This is effective since a typical person can only accumulate an ESD charge of about 15 mJ. The values provided above are for purposes of example only. In other implementations, an activation assembly can be configured to withstand higher or lower ESD stimuli.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A tool for use in a wellbore, comprising:
an activation assembly having:
a support structure,
a reactive layer on the support structure, the reactive layer including an intermetallic material, and
an electrically conductive protective layer covering the reactive layer to protect the reactive layer from electrical discharge; and
a component to be activated by the activation assembly.

2. The tool of claim 1, wherein the component comprises an explosive.

3. The tool of claim 2, wherein the explosive comprises a propellant.

4. The tool of claim 2, further comprising a perforating gun, the explosive being in the perforating gun.

5. The tool of claim 2, wherein the activation assembly is generally shaped as a disk, the disk contacted to an end of the explosive.

6. The tool of claim 1, wherein the reactive layer comprises a reactive nanofoil that contains the intermetallic material.

7. The tool of claim 6, wherein the intermetallic material is formed of one of the following compositions:
(1) aluminum and nickel; (2) aluminum and palladium; and (3) titanium and boron.

8. The tool of claim 1, wherein the component comprises an explosive, wherein the activation assembly has a surface that contacts a surface of the explosive such that initiation of the reactive layer causes substantially simultaneous initiation of an entire surface of the explosive.

9. A tool for use in a wellbore, comprising:
an activation assembly having:
a support structure,
a reactive layer on the support structure, the reactive layer formed of a pyrotechnic material, and
an electrically conductive protective layer covering the reactive layer to protect the reactive layer from electrical discharge; and
an explosive to be activated by the activation assembly,
wherein the explosive is generally cylindrical in shape, and wherein the activation assembly is wrapped around a curved surface of the explosive.

10. The tool of claim 9, wherein the support structure, reactive layer, and electrically conductive protective layer are generally cylindrical in shape.

11. A tool comprising:
a component; and
an activation assembly to activate the component, the activation assembly comprising:
a support structure;
a reactive layer comprising a pyrotechnic material;
an electrically conductive protective layer that covers the reactive layer to protect the reactive layer from electrostatic discharge,
wherein the reactive layer positioned between the support structure and the protective layer, and
wherein the activation assembly is generally cylindrical in shape to wrap around the component.

12. The tool of claim 11, wherein the pyrotechnic material comprises an intermetallic material.

13. The tool of claim 12, wherein the intermetallic material comprises one of the following compositions: (1) aluminum and nickel; (2) aluminum and palladium; and (3) titanium and boron.

14. The tool of claim 11, wherein the pyrotechnic material comprises one of (1) titanium; (2) potassium-perchlorate; and (3) zirconium.

15. The tool of claim 11, further comprising electrical leads connected to points on the reactive layer to couple an electrical energy to the reactive layer from an energy storage device.

16. The tool of claim 11, wherein the component comprises a generally cylindrical explosive wrapped by the activation assembly.

* * * * *